US010288395B1

(12) United States Patent
Barton

(10) Patent No.: US 10,288,395 B1
(45) Date of Patent: May 14, 2019

(54) NOSECONE INVERTED F ANTENNA FOR S-BAND TELEMETRY

(71) Applicant: The United States of America as Represented by the Secretary of the Army, Washington, DC (US)

(72) Inventor: Aaron Elie Barton, Oswego, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 170 days.

(21) Appl. No.: 15/614,971

(22) Filed: Jun. 6, 2017

Related U.S. Application Data

(60) Provisional application No. 62/347,690, filed on Jun. 9, 2016.

(51) Int. Cl.

| | |
|---|---|
| ***F42B 12/36*** | (2006.01) |
| ***H01Q 1/28*** | (2006.01) |
| ***F42B 15/01*** | (2006.01) |
| ***F41G 7/34*** | (2006.01) |
| ***F42B 30/00*** | (2006.01) |
| ***F41G 7/30*** | (2006.01) |
| *F42B 12/00* | (2006.01) |

(52) U.S. Cl.
CPC ..... *F42B 12/365* (2013.01); *F41G 7/306* (2013.01); *F41G 7/346* (2013.01); *F42B 15/01* (2013.01); *F42B 30/006* (2013.01); *H01Q 1/281* (2013.01); *H01Q 1/286* (2013.01)

(58) Field of Classification Search
CPC ..... F42B 12/365; F42B 15/01; F42B 30/006; H01Q 1/281; H01Q 1/286; F41G 7/346; F41G 7/306
See application file for complete search history.

(56) References Cited

U.S. PATENT DOCUMENTS

| | | | | |
|---|---|---|---|---|
| 3,798,653 A * | 3/1974 | Jones, Jr. | ..... | H01Q 1/281 343/708 |
| 6,218,992 B1 | 4/2001 | Sadler et al. | | |
| 6,630,907 B1 | 10/2003 | Ryken et al. | | |
| 7,193,567 B1 | 3/2007 | Ryken et al. | | |
| 8,159,403 B1 * | 4/2012 | Chen | ..... | H01Q 1/281 343/705 |

(Continued)

FOREIGN PATENT DOCUMENTS

| | | | | |
|---|---|---|---|---|
| JP | 2000022434 A * | 1/2000 | ..... | H01Q 1/281 |
| WO | 2017037696 | 8/2016 | | |

OTHER PUBLICATIONS

J. H. Bang et al., "A Compact GPS Antenna for Artillery Projectile Applications"; IEEE Antennas and Wireless Propagation Letters; vol. 10; pp. 266-269; IEEE, Piscataway, NJ, USA; May 3, 2011. (Year: 2011).*

(Continued)

*Primary Examiner* — Bernarr E Gregory
(74) *Attorney, Agent, or Firm* — John P. DiScala

(57) ABSTRACT

An inverted F antenna for use in a projectile includes a ground plane and a radiating element oriented orthogonal to the ground plane and centered on the ground plane. The radiating element includes a ground stub trace having a relatively thick width, a meandering trace with a vertical orientation and a relatively high ground clearance and a feed trace having a tapered head.

20 Claims, 12 Drawing Sheets

(56) References Cited

U.S. PATENT DOCUMENTS

| | | | | |
|---|---|---|---|---|
| 8,207,893 | B2 * | 6/2012 | Baliarda | H01Q 1/36 343/700 MS |
| 2002/0029716 | A1 * | 3/2002 | Koch | H01Q 1/281 102/293 |
| 2007/0229366 | A1 * | 10/2007 | Kim | H01Q 1/243 343/700 MS |
| 2009/0315786 | A1 * | 12/2009 | Ryou | H01Q 1/242 343/702 |

OTHER PUBLICATIONS

A. Barton, "Nosecone Inverted-F Antenna (IFA) for S-Band Telemetry"; Technical Report ARMET-TR-16075; U.S. Army Armament Research, Development and Engineering Center, Munitions Engineering Technology Center, Picatinny Arsenal, NJ, USA; Sep. 2017. (Year: 2017).*

Andersen, Application Note AN043 Small Size 2.4 GHz PCB Antenna, Nov. 28, 2006, Texas Instruments Inc., Dallas, TX.

Freescale Semiconductors, Application Note AN2731 Compact Integrated Antennas Rev. 3, Sep. 2015, Freescale Semiconductor, Inc., Austin, TX.

Texas Instruments, Application Report SWRU120C 2.4 GHz Inverted F Antenna, Apr. 2007, Texas Instruments Inc., Dallas, TX.

Rosu, PIFA—Planar Inverted F Antenna, 2008, retrieved from http://www.qsl.net/va3iul/.

Fujimoto, Modern Small Antennas, 2014, pp. 93-94, Cambridge University Press, New York, NY.

Stutzman, Antenna Theory and Design, 2012, p. 504, John Wiley & Sons, Inc., Hoboken, NJ.

* cited by examiner

NOSECONE INVERTED F ANTENNA FOR S-BAND TELEMETRY

CROSS-REFERENCE TO RELATED APPLICATIONS

This application claims the benefit under 35 USC § 119(e) of U.S. provisional patent application 62/347,690 filed on Jun. 9, 2016.

STATEMENT OF GOVERNMENT INTEREST

The inventions described herein may be manufactured, used and licensed by or for the United States Government.

BACKGROUND OF THE INVENTION

The invention relates in general to munitions and in particular to Radio Frequency communication with munitions.

Inverted-F antennas (IFAs) are a popular choice for wireless consumer electronics because they can easily be included within circuitry as additional artwork on printed circuit boards (PCBs). Numerous design variations exist to facilitate communication standards such as Wi-Fi.

Antennas are typically used in artillery, mortar, tank, and other munitions for global positioning system (GPS) or telemetry capabilities. Since the bodies of munitions are mostly metal, and since their outer profile must be maintained for flight characteristics, they provide a more challenging antenna placement problem than typical consumer products, whose chassis tend to be made of plastic and which can allow for protruding antennas such as monopole whips or blades.

One antenna solution that is commonly used is to place several patch antennas around the body of the munition in a wrap-around configuration. The main lobe of each patch covers an angular sector around the azimuthal plane of the munition. These antennas can either be individual patches placed in a pocket on the side of the round, or they can be made on a single curved substrate to form an array that is wrapped around the circumference of the munition. The metal body of the munition acts as the ground plane for the patches.

However, there are downsides associated with patch antenna use on munitions. Multiple patch antennas in the form of an array are required in order to provide azimuthal coverage around the projectile, additionally requiring a RF power splitting network. This adds complexity, extra volume, and cost.

Another option is to attempt to cut slots in the body of the munition to form slot antennas. However, as the slot will affect the structural integrity of the munitions, this option is limited to only high frequency communication links where the slot dimensions can be made small.

An alternative option to mounting antennas on the munition body is to attempt to integrate antennas on the very extreme ends of the munitions—the nose or the fins—and use the remainder of the projectile as a ground plane. Using the nose usually requires that the nosecone be made of a plastic material to support an embedded monopole, patch, or scimitar. Additionally, monopole antennas require a full ¼-wavelength of length available at the operating frequency, and additional require an external RF matching network to achieve a nominal 50 ohm input impedance.

A need exists for an improved antenna which may be employed on a munition that is effective but relatively small and inexpensive.

SUMMARY OF INVENTION

One aspect of the invention is an inverted F antenna for use on a projectile. The inverted F antenna comprises a ground plane and a radiating element which are orthogonal to each other. The radiating element further comprises a ground stub trace, a feed trace and a meandering trace.

A second aspect of the invention is a nosecone for a projectile comprising an inverted F antenna in an interior volume of the nosecone. The inverted F antenna comprises a ground plane and a radiating element which are orthogonal to each other. The radiating element further comprises a ground stub trace, a feed trace and a meandering trace.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

An inverted F antenna employed in the nosecone of a projectile offers improved performance for communication and telemetry while being electrically small and inexpensive. The inverted F antenna provides azimuthal coverage around the projectile without requiring an array of antennas. Additionally, the antenna utilizes unused volume within the nosecone which is typically not used for electronics. The inverted F antenna requires no additional matching circuitry to achieve a nominal 50 ohm input impedance. Finally, the antenna may be manufactured using relatively inexpensive printed circuit board (PCB) components.

Figure 1:
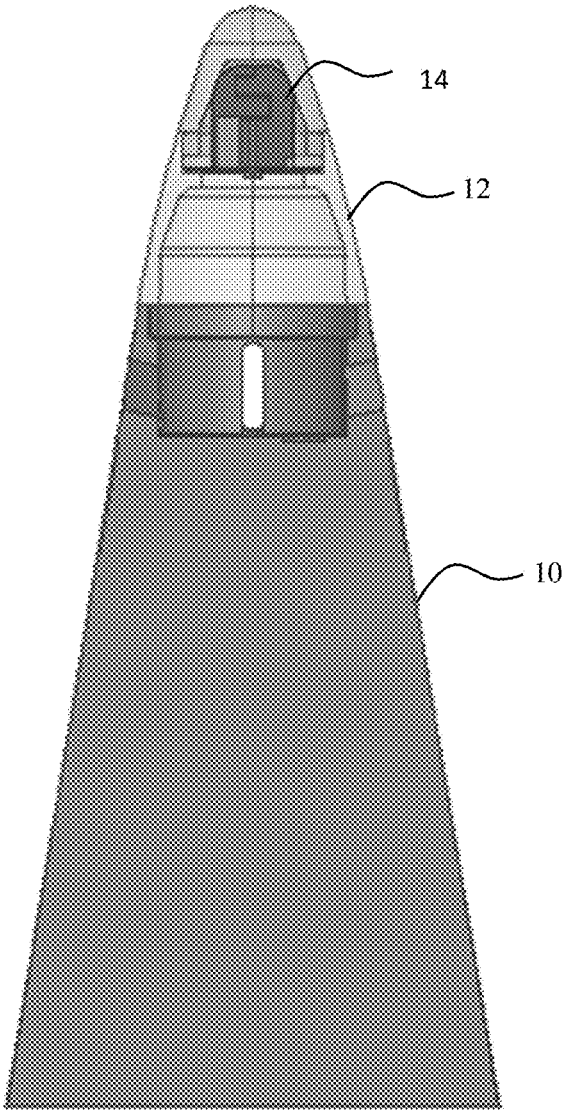
FIG. 1 is a cross sectional view of an upper half of a projectile, in accordance with one illustrative embodiment.

FIG. 1 is a cross sectional view of an upper half of a projectile, in accordance with one illustrative embodiment. Projectiles typically employ antenna elements for communications and telemetry. For example, Antennas are typically used in artillery, mortar, tank, and other munitions for global positioning system (GPS) or telemetry capabilities. The projectile 10 shown in FIG. 1 may be a 155 mm artillery munition or a 120 mm mortar munition. However, the projectile 10 is not limited to these munitions or munitions in general. The inverted F antenna described 14 herein may be employed on any projectile 10 comprising a nosecone 12.

Typically, communications with projectiles 10 following the IRIG 106 telemetry standard communicate in the S band of the electromagnetic spectrum. Accordingly, the inverted F antenna 14 is designed to communicate in the frequencies within the S Band to support telemetry applications. In one particular embodiment, the inverted F antenna 14 is sized to communicate at approximately 2.25 gigahertz (GHz).

Figure 2:
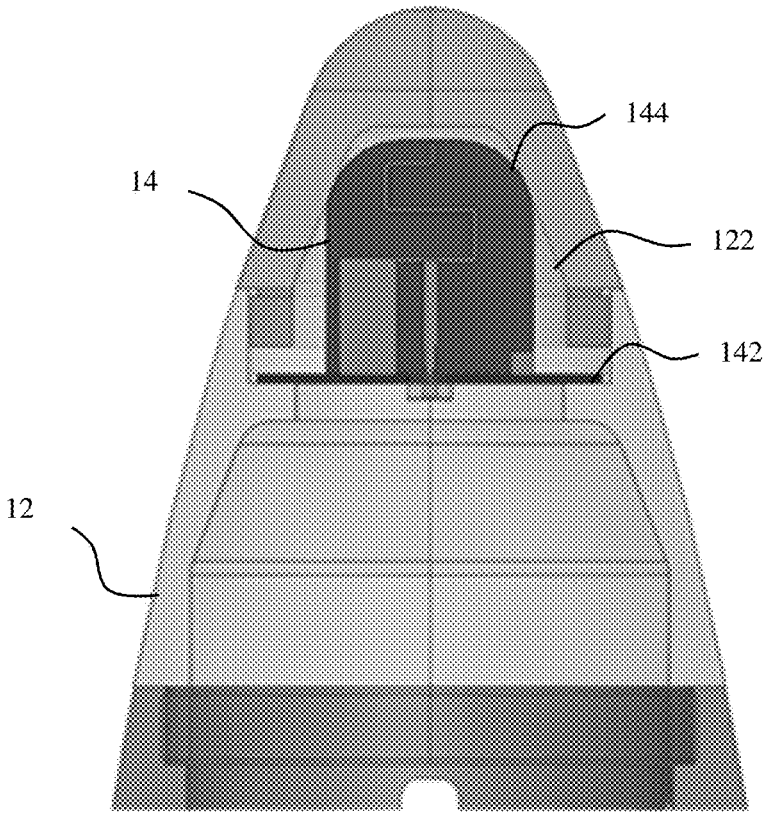
FIG. 2 is a cross sectional view of a nosecone for a projectile, in accordance with one illustrative embodiment.

In addition to being sized and dimensioned for communication in the S-Band, the inverted F antenna 14 is also electrically small and sized and dimensioned to fit within an interior volume of the nosecone 12 as defined by the outer contour of the nosecone 12. FIG. 2 is a cross sectional view of a nosecone for a projectile, in accordance with one illustrative embodiment. The projectile 10 further comprises a nosecone 12 at the forward most portion of the projectile 10. The nosecone 12 is inserted into and secured to the projectile body provides a surface to minimize aerodynamic resistance on the projectile 10.

The STANAG 2916 standard used by the North Atlantic Treaty Organization (NATO) defines a standard profile contour for artillery and mortar projectile nose cones. Advantageously, the inverted F antenna 14 described herein is sized and dimensioned to fit within the interior volume of a nosecone conforming to the STANAG 2916 contour standards. In one embodiment, the nosecone 12 has the outer dimensions prescribed in the STANAG 2916 standard and is constructed of Ultem 2300 polyetherimide material. Ultem 2300 is a 30% glass fiber filled standard flow polyetherimide available from SABIC of Saudi Arabia.

The inverted F antenna 14 is mounted within an interior cavity of the nosecone 12. The remaining interior cavity may be filled with filler material 122, such as dielectric foam, providing high-g shock survivability for the inverted F antenna. In an embodiment, the filler material 122 is ECCO-STOCK 12-10H filler material.

The inverted F antenna 14 comprises a ground plane 142 and a radiating element 144 extending orthogonally from the ground plane 142. The ground plane 142 is mounted within the nosecone 12 with the radiating element 144 extending into the nosecone 12 and toward the tip of the nosecone 12.

Figure 3:
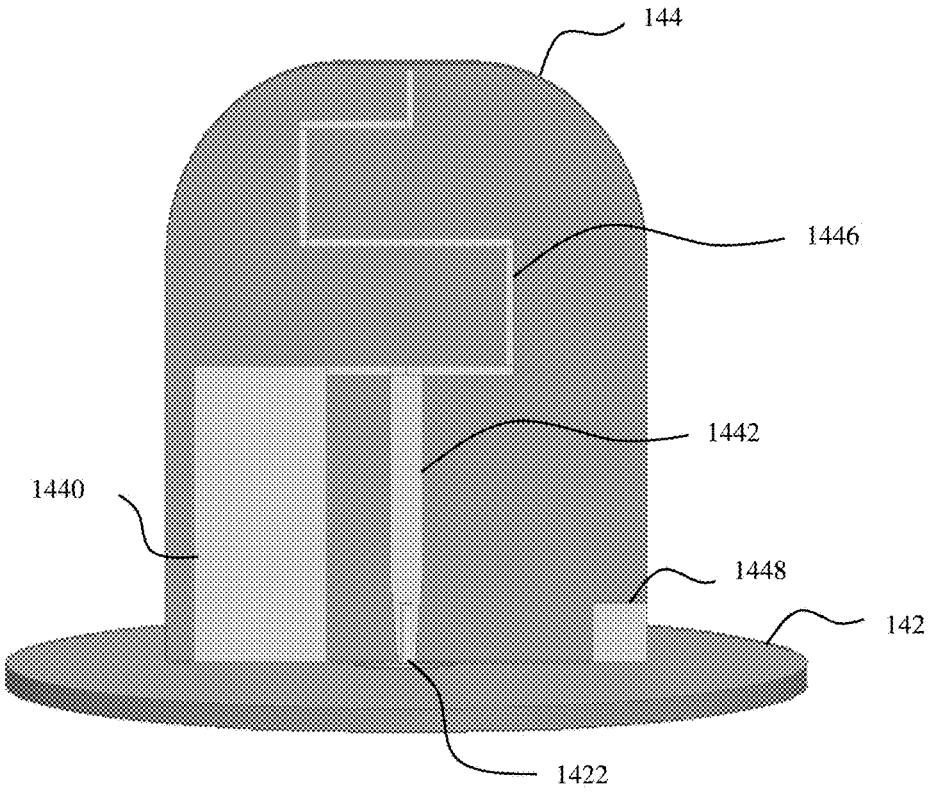
FIG. 3 shows an inverted F antenna, in accordance with one illustrative embodiment.

FIG. 3 shows an inverted F antenna, in accordance with one illustrative embodiment. The ground plane 142 comprises a circular printed circuit board (PCB) to accommodate the circular shape of the nosecone 12. In an embodiment, the ground plane 142 is implemented as a copper plane on an 0.031" FR4 printed circuit board having an 30 mm outer diameter. Through holes are provided in the printed circuit board to support a board mount SMA connector.

The radiating element 144 extends orthogonally from the ground plane 142 and comprises a ground stub trace 1442, a feed trace 1444 and a meandering trace 1446. In an embodiment, the radiating element 144 is implemented as traces on a printed circuit board, such as a 0.031" FR4 board. The radiating element 144 is soldered to the ground plane 142 at the ground plane stub and at a mechanical support 1242 mounted at a bottom edge of the radiating element PCB. A feeding probe extending from the board mount SMA connector extending through the ground plane PCB is soldered to the feed trace 1444.

The radiating element 144 is substantially centered due to the limited interior volume available in the nosecone 12 and the application of the inverted F antenna 14 in a projectile 10. In applications in which the projectile 10 is a high spin projectile or a spin stabilized projectile, the centered radiating element 144 minimizes the moment of inertia of the radiating element 144 about the axis of rotation. Accordingly, the mechanical stresses experienced by the inverted F antenna 14 during flight are minimized and thereby the risk of failure is reduced. In an embodiment, the feed trace 1444 and the uppermost leg of the meandering trace 1446 are approximately in line with the center of the ground plane 142. However, in other embodiments, the feed trace 1444 and uppermost leg of the meandering trace 1446 do not need to be substantially in line with the center of the ground plane 142 to be substantially centered. A radiating element 144 is substantially centered if a center of gravity of the meandering trace 1446 lies above the middle portion of the ground trace. The middle portion of the ground plane 142 is the region between one quarter and three quarters of the diameter of the ground plane 142.

Figure 4:
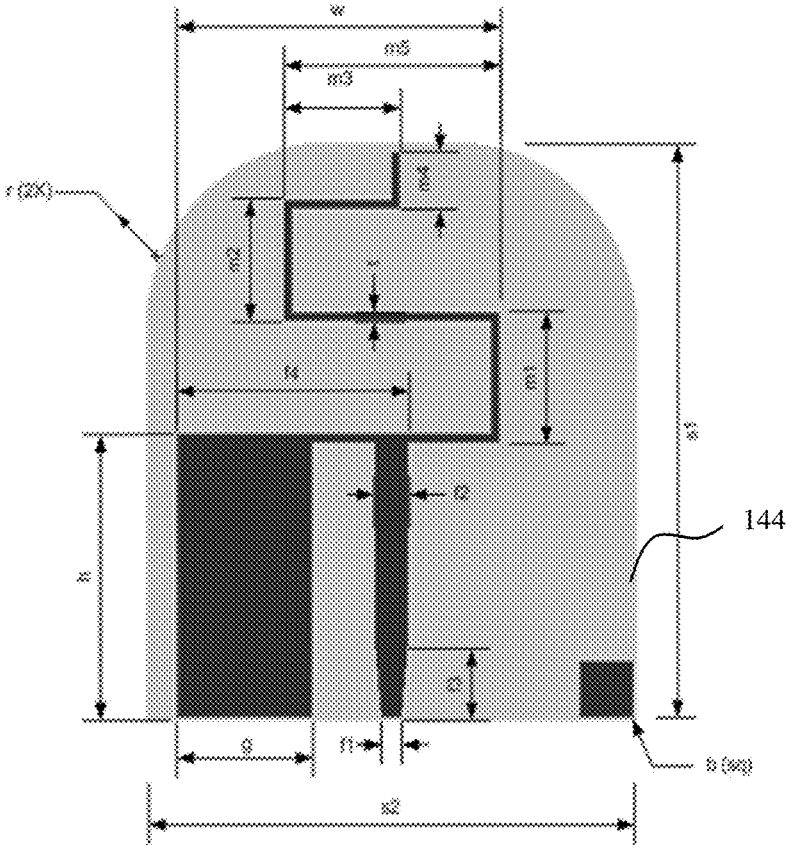
FIG. 4 is a front elevation view of a radiating element of an inverted F antenna, in accordance with one illustrative embodiment.

FIG. 4 is a front elevation view of a radiating element of an inverted F antenna, in accordance with one illustrative embodiment. The radiating element 144 was sized and dimensioned according to the frequency of S band communications, the physical limits of a projectile nosecone and the potential application in high spin projectiles. Several features of the antenna 14 including a relatively wide ground stub trace 1442, a relatively large ground plane separation, a tapered feed trace 1444 and a vertically oriented meandered trace.

The ground stub trace 1442 is rectangular and extends from a bottom edge of the radiating element printed circuit board orthogonal to the ground plane printed circuit board. The ground stub 1442 trace has a width that is substantially wider than the width of the meandering trace 1446. In one embodiment, the ground stub trace 1442 is over 16 times wider than the meandering trace 1446.

The feed trace 1444 is rectangular with a tapered head extending from a bottom edge of the radiating element printed circuit board orthogonal to the ground plane printed circuit board. The tapered head is positioned substantially at the center of the ground plane 142 and is soldered to the feeding probe extending from the board mount SMA connector.

The meandering trace 1446 is coupled to the ground stub trace 1442 and the feed trace 1444 and extends in a vertical orientation away from the ground plane 142. The meandering trace 1446 meanders vertically up the printed circuit board and is centered on the center of the ground plane 142. The meandering trace 1446 terminates at a top edge of the radiating element printed circuit board and approximately lying above the center of the ground plane 142.

The meandering trace 1446 extends from the ground stub trace 1442 to the feed trace 1444 parallel to the ground plane 142 to a first vertex. At the first vertex, the meandering trace 1446 bends 90 degree bend and extends orthogonal to the ground plane 142 from the first vertex to a second vertex. At the second vertex, the meandering trace 1446 again bends 90 degrees and extends parallel to the ground plane 142 from the second vertex to a third vertex. At the third vertex, the meandering trace 1446 bends 90 degrees and extends orthogonal to the ground plane 142 from the third vertex to a fourth vertex. At the fourth vertex, the meandering trace 1446 bends 90 degrees and extends parallel to the ground plane 142 from the fourth vertex to a fifth vertex. At the fifth vertex, the meandering trace 1446 bends 90 degrees and extends orthogonal to the ground plane 142 from the fifth vertex to an end point.

In one embodiment, the radiating element 144 has the dimensions listed in Table 1 below, with dimensional labels corresponding to those shown in FIG. 4.

TABLE 1

| Name | Value |
|---|---|
| H | 10 mm |
| G | 5 mm |
| Fl | 0.7 mm |
| F2 | 1.2 mm |
| F3 | 2.986 mm |
| F4 | 8.55 mm |
| M1 | 4.6 mm |
| M2 | 4.3 mm |
| M3 | 4.3 mm |
| M4 | 2 mm |
| M5 | 8 mm |
| T | 0.3 mm |
| W | 11.95 mm |
| B | 2 mm |
| S1 | 20.2 mm |
| S2 | 18 mm |
| R | 6.6 mm |

Simulations of the inverted F antenna 14 with the geometry shown in FIG. 4 and the dimensions listed above were performed using Ansoft HFSS 2014 edition, available from ANSYS, Inc. of Canonsburg, Pa. A discrete sweep simulation was used for return loss plots, consisting of 200 linearly stepped points from 2 gigahertz (GHz) to 3 GHz. A single solution at 2.254 GHz was used for all radiation plots. All geometry was surrounded by a radiation absorbing ABC layer. Far-field calculations are derived from a virtual radiation surface within the outer boundary. The antenna traces were modeled as thin, 20 micrometer (μm) thick rectangular perfect electrical conductor (PEC) volumes; the ground plane 142 was modeled as a 30 millimeter (mm) diameter sheet with PEC boundary conditions, with a cutout for a coaxial feed. The material properties of the simulation materials are provided in Table 2 below.

TABLE 2

| Name | Rel. Permittivity | Dielectric Loss Tangent | Rel. Permeability | Bulk Cond. (s/m) |
|---|---|---|---|---|
| ECCOSTOCK | 1.25 | 0.005 | 1 | 0 |
| PEC | 1 | 0 | 1 | 1e30 |
| Teflon | 2.1 | 0.001 | 1 | 0 |
| Ultem | 3.5 | 0.0014 | 1 | le−15 |
| Vacuum | 1 | 1 | 0 | 0 |

Measurements of the inverted F antenna 14 with the geometry shown in FIG. 4 and the dimensions listed above in Table 1 were performed, as well. The return loss of the antenna 14 was measured using an HP 8753E vector network analyzer (VNA). The antenna 14 was mounted in the Ultem 2300 nosecone 12 and encapsulated with the ECCOSTOCK foam. The VNA was connected directly to the SMA connector on the underside of the ground plane 142 using coaxial cables.

The radiation pattern of the antenna 14 was measured in an anechoic chamber. The antenna 14 was mounted on the upper portion of an M795 projectile. A metal ogive sections was included between the nosecone 12 and the upper portion.

The antenna 14 was measured in two orientations, vertical and horizontal. Vertically oriented, the antenna 14 was placed in the center of a turntable and spun to gather the radiation pattern in the azimuthal plane. This pattern was measured twice, once with the receiver horn antenna polarized vertically (i.e. co-polarization) and once with the receiver horn antenna polarized horizontally (cross-polarization).

Horizontally oriented, the antenna 14 was placed on the turntable lying flat, with the axis of rotation coincident with the bottom threads of the upper half of the projectile 10. The antenna 14 was supported above the table with foam blocks and spun to collect the radiation pattern in the elevation plane. This pattern was measured twice, once with the receiver horn antenna polarized vertically (i.e. co-polarization) and once with the receiver horn antenna polarized horizontally (cross-polarization).

Figure 5:
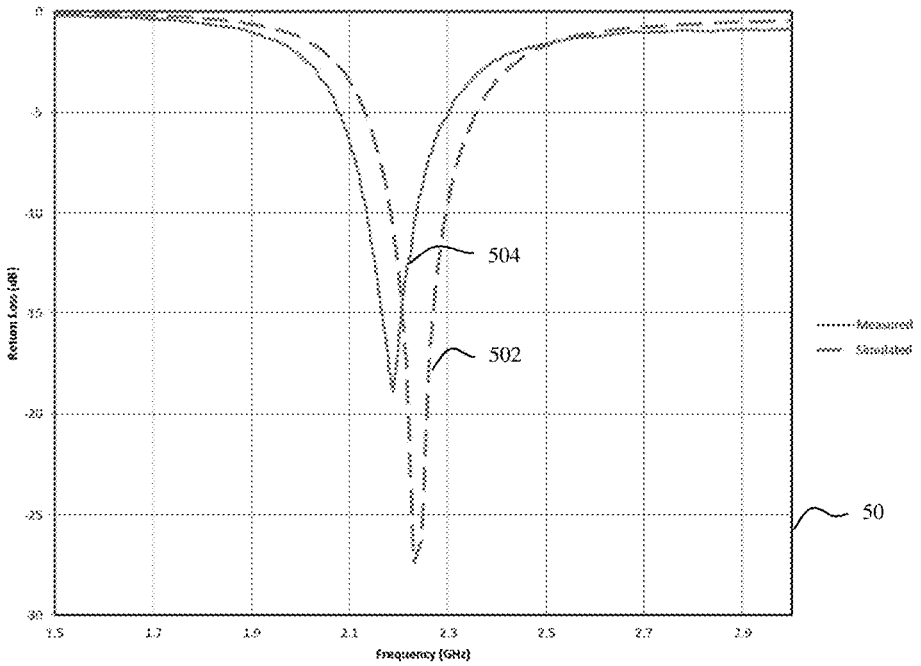
FIG. 5 is a plot showing a measured return loss and a simulated return loss of the inverted F antenna of FIG. 3 and FIG. 4, in accordance with one illustrative embodiment.

FIG. 5 is a plot showing a measured return loss and a simulated return loss of the inverted F antenna of FIG. 3 and FIG. 4, in accordance with one illustrative embodiment. In the plot 50, the simulated return loss 502 is shown in dashed line and the measured return loss 504 is shown in a solid line. The minimum measured return loss was detected at −18.9 dB at a center frequency of 2.19 GHz. The impedance bandwidth of the antenna (S11<−10 dB) was measured to be 100 MHz (4.5%), from 2.14 GHz to 2.24 GHz. This is in close agreement with the simulated return loss, which showed a minimum of −27.3 dB at 2.23 GHz (a 2% frequency error with respect to measurement) and an impedance bandwidth of 110 MHz (4.9%) from 2.18 GHz to 129 GHz.

Figure 6A:
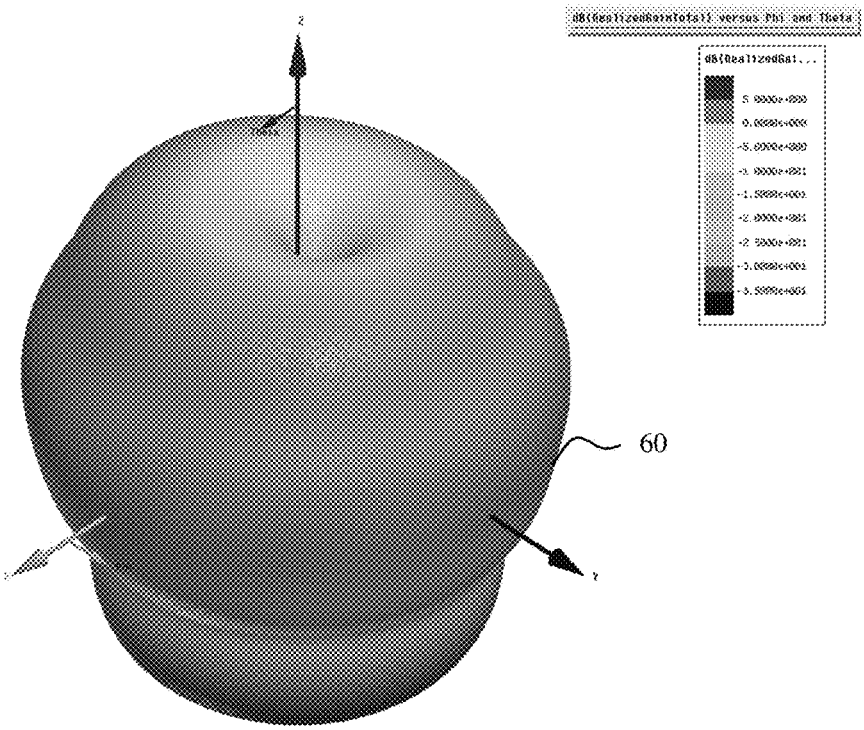
FIG. 6 includes FIG. 6*a* and FIG. 6*b* which are respectively, a top view and a bottom view of the radiation pattern of the inverted F antenna of FIG. 3 and FIG. 4, in accordance with one illustrative embodiment.
Figure 6B:
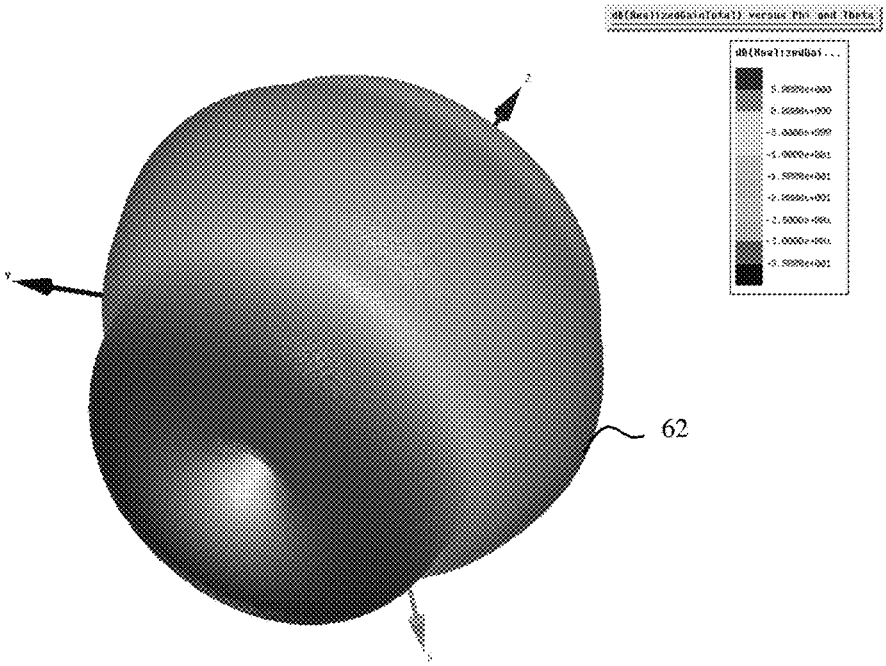
Figure 7:
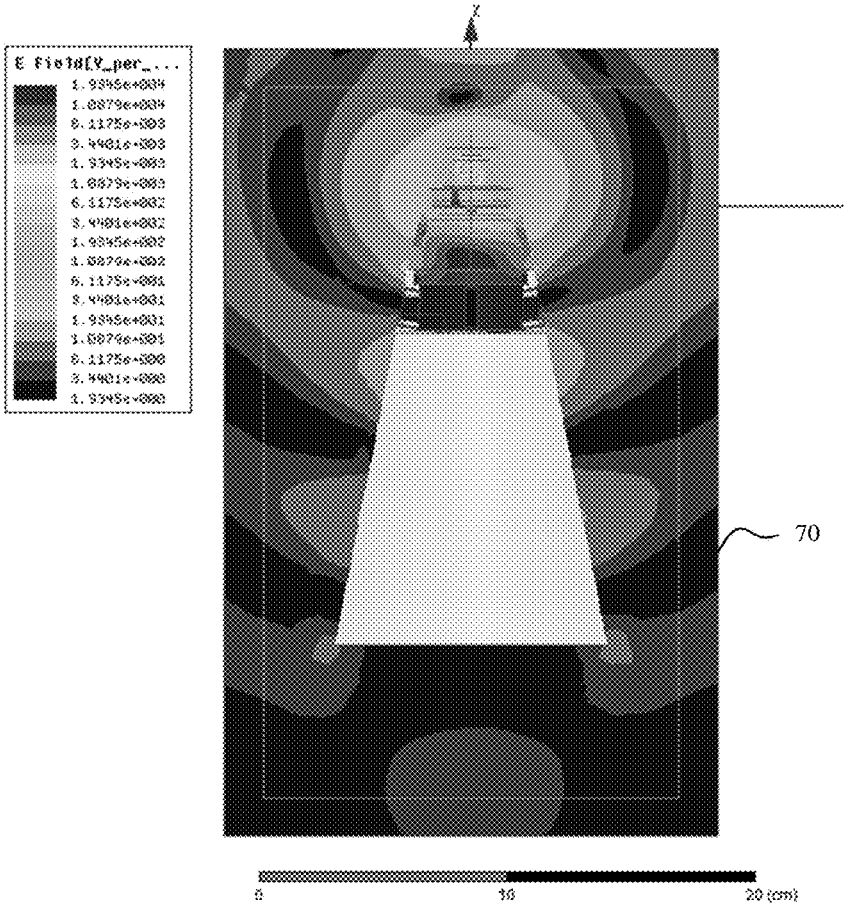
FIG. 7 is an E-field magnitude plot in the XZ plane of the inverted F antenna of FIG. 3 and FIG. 4, in accordance with one illustrative embodiment.

FIG. 6 includes FIG. 6*a* and FIG. 6*b* which are respectively, a top view and a bottom view of 3D renderings of the radiation pattern of the inverted F antenna of FIG. 3 and FIG. 4, in accordance with one illustrative embodiment. FIG. 7 is an E-field magnitude plot in the XZ plane of the inverted F antenna of FIG. 3 and FIG. 4, in accordance with one illustrative embodiment. As shown in the 3D renderings 60, 62, the antenna radiation pattern at the intended operating frequency is generally omni-directional in the azimuthal plane. The pattern is similar to that of a dipole, with two nulls located at the top and bottom. As seen in the E-field plot 70, diffraction is observed to occur around the sides of the projectile 10.

Figure 8:
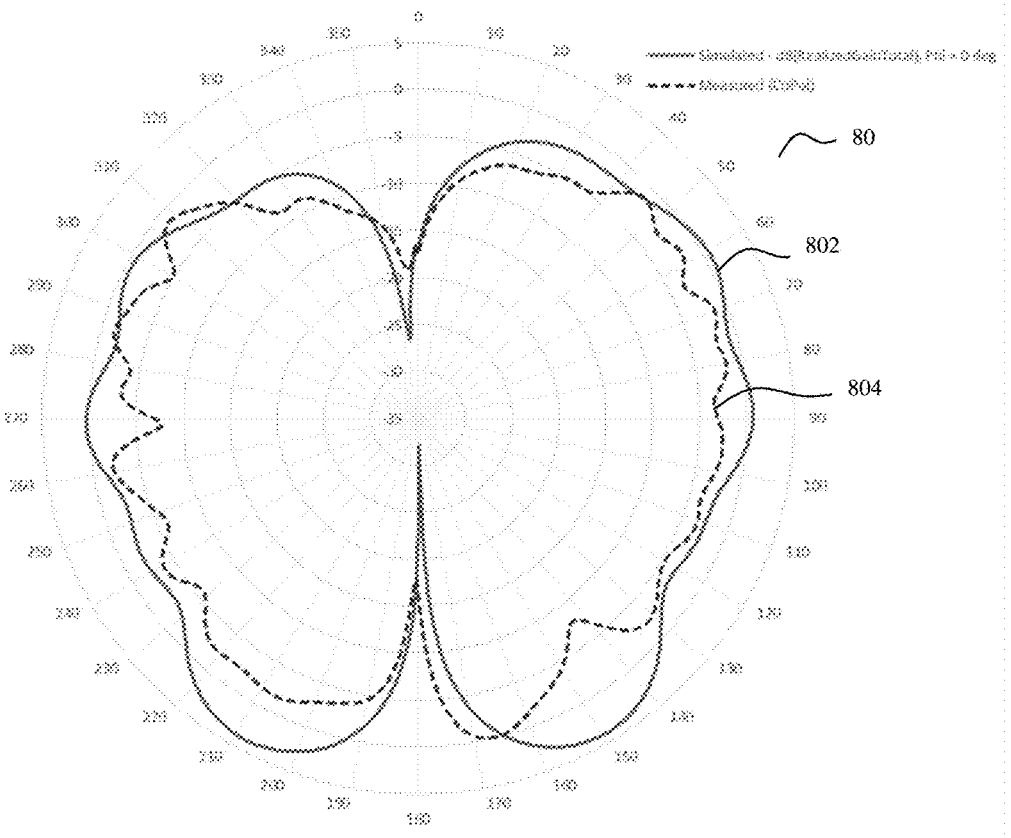
FIG. 8 is a plot showing a measured radiation pattern and a simulated radiation pattern at an elevation plane of the inverted F antenna of FIG. 3 and FIG. 4, in accordance with one illustrative embodiment.

FIG. 8 is a plot showing a measured radiation pattern and a simulated radiation pattern at an elevation plane of the inverted F antenna of FIG. 3 and FIG. 4, in accordance with one illustrative embodiment. In the plot 80, the simulated radiation pattern 802 is shown in a solid line and the measured radiation pattern 804 is shown as a dashed line. The maximum gain measured was 0 dBi, with an angular coverage (herein defined as gain >−10 dBi) of approximately 150 to 170 degrees, varying with the azimuthal angle. The simulation yielded a maximum gain of 4 dBi, with an angular coverage of approximately 161 to 168 degrees. Gain is maximized towards the rear of the M795 projectile.

Figure 9:
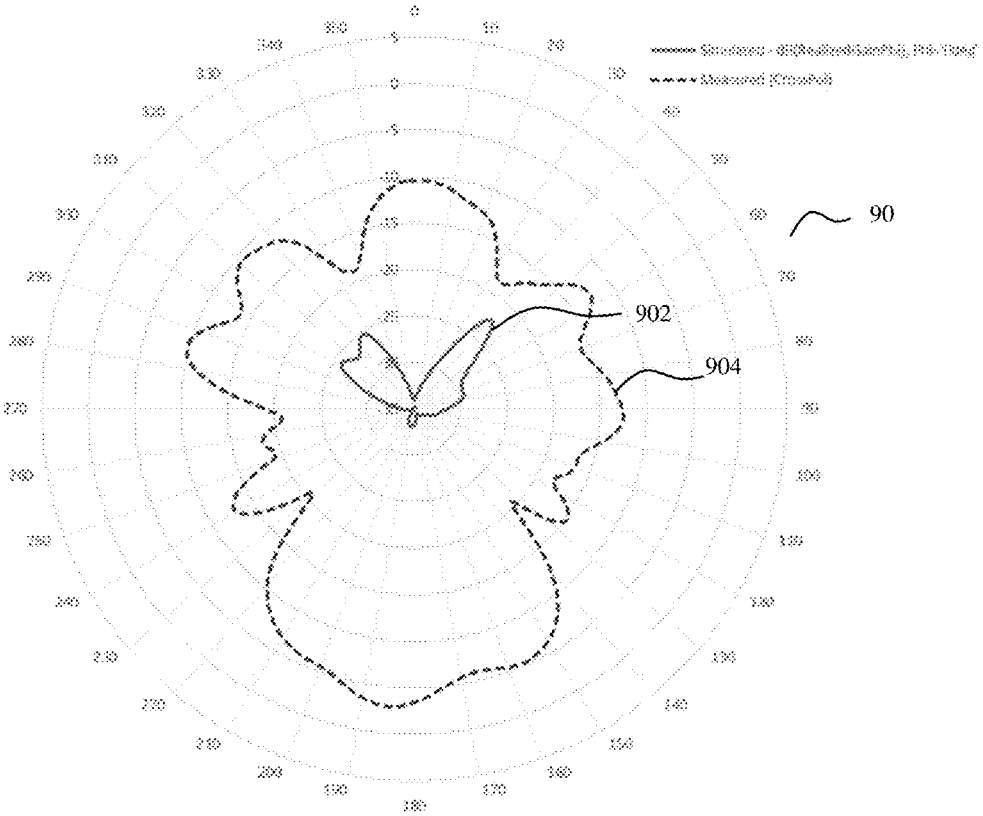
FIG. 9 is a plot showing a measured radiation pattern and a simulated radiation pattern with a cross-polarization and at an elevation plane of the inverted F antenna of FIG. 3 and FIG. 4, in accordance with one illustrative embodiment.

FIG. 9 is a plot showing a measured radiation pattern and a simulated radiation pattern with a cross-polarization and at an elevation plane of the inverted F antenna of FIG. 3 and FIG. 4, in accordance with one illustrative embodiment. In the plot, the simulated radiation pattern 902 is shown in a solid line and the measured radiation pattern 904 is shown in dashed line. A maximum measurement of −2.8 dBi was detected, as compared to a maximum simulation result of −34.7 dBi.

Figure 10:
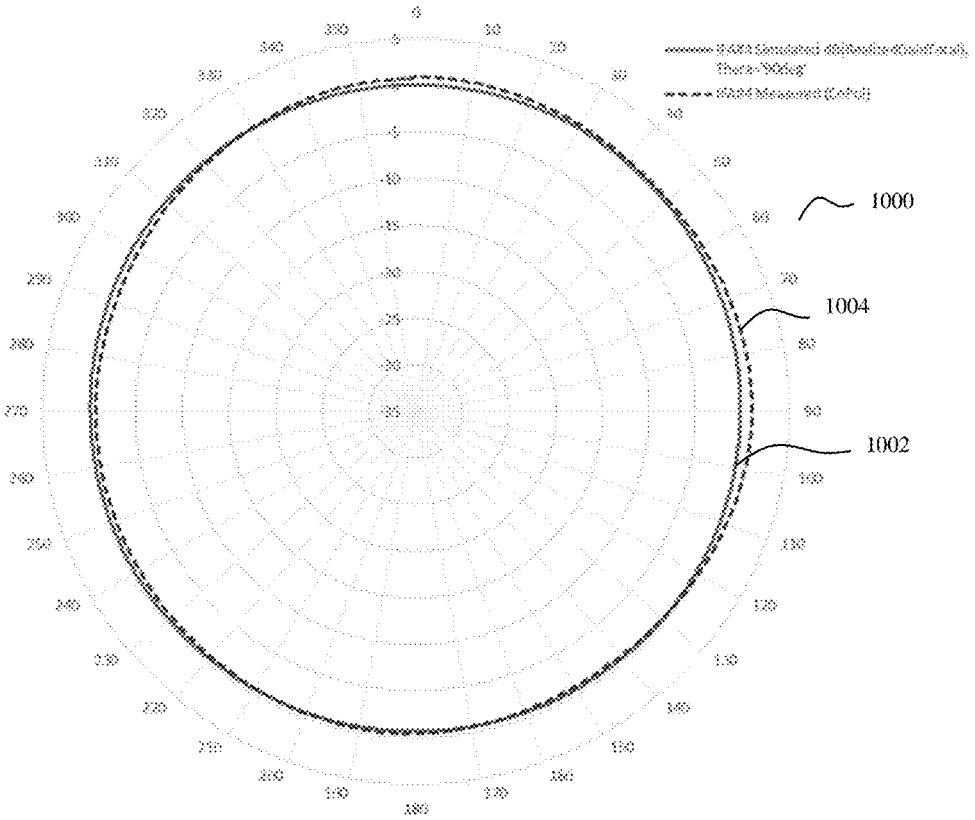
FIG. 10 is a plot showing a measured radiation pattern and a simulated radiation pattern at an azimuthal plane of the inverted F antenna of FIG. 3 and FIG. 4, in accordance with one illustrative embodiment.

FIG. 10 is a plot showing a measured radiation pattern and a simulated radiation pattern at an azimuthal plane of the inverted F antenna of FIG. 3 and FIG. 4, in accordance with one illustrative embodiment. In the plot 1000, the simulated radiation pattern 1002 is shown in a solid line and the measured radiation pattern 1004 is shown in dashed line. Both in the measured pattern 1004 and the simulated pattern 1002 show excellent symmetry around the center of axis. An antenna having a symmetrical pattern as observed in FIG. 10 is particularly suited for application in a spinning projectile.

Figure 11:
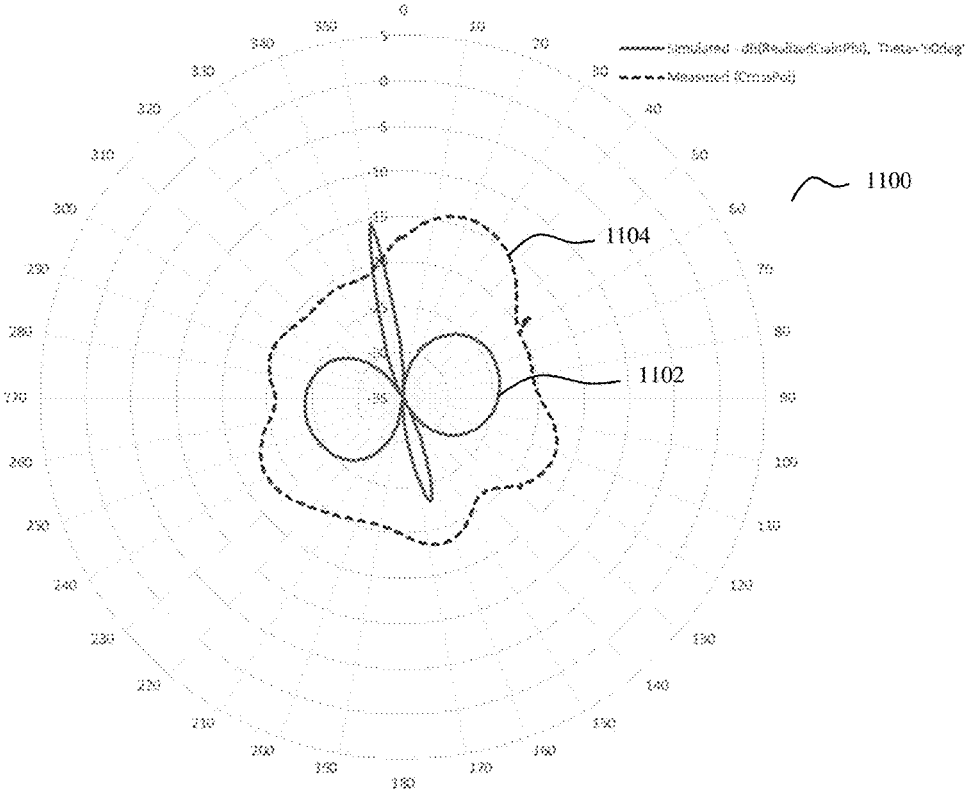
FIG. 11 is a plot showing a measured radiation pattern and a simulated radiation pattern with a cross-polarization and at an azimuthal plane of the inverted F antenna of FIG. 3 and FIG. 4, in accordance with one illustrative embodiment.

FIG. 11 is a plot showing a measured radiation pattern and a simulated radiation pattern with a cross-polarization and at an azimuthal plane of the inverted F antenna of FIG. 3 and FIG. 4, in accordance with one illustrative embodiment. In the plot, the simulated radiation pattern 1102 is shown in a solid line and the measured radiation pattern 1104 is shown in dashed line. A maximum measurement of −13.9 dBi was measured compared to a maximum simulation result of −24.1 dBi.

While the invention has been described with reference to certain embodiments, numerous changes, alterations and modifications to the described embodiments are possible without departing from the spirit and scope of the invention as defined in the appended claims, and equivalents thereof.

What is claimed is:

1. An inverted F antenna for use in the nosecone of a projectile, the inverted F antenna comprising:
- a ground plane configured for being mounted within the opening of the nosecone; and
- a radiating element extending orthogonally from the ground plane and centered on the ground plane, the radiating element further comprising a ground stub trace, a feed trace and a meandering trace.

2. The antenna of claim 1 wherein the ground plane is mounted on a first printed circuit board and the radiating element is a trace on a second printed circuit board.

3. The antenna of claim 1 wherein the antenna is sized and dimensioned to communicate in the S band of the electromagnetic spectrum.

4. The antenna of claim 1 wherein the ground stub trace is wider than the meandering trace.

5. The antenna of claim 4 wherein the ground stub trace is approximately sixteen times wider than the meandering trace.

6. The antenna of claim 1 wherein the feed trace is wider than the meandering trace.

7. The antenna of claim 1 wherein the feed trace has a tapered head.

8. The antenna of claim 7 wherein the feed trace lies approximately over the center of the ground plane.

9. The antenna of claim 1 wherein the ground plane separation of the meandering trace is 10 millimeters.

10. The antenna of claim 1 wherein the meandering trace comprises
- a first leg extending from the ground stub trace to the feed trace parallel to the ground plane to a first vertex,
- a second leg extending orthogonal to the ground plane from the first vertex to the second vertex,
- a third leg extending parallel to the ground plane from the second vertex to a third vertex,
- a fourth leg extending orthogonal to the ground plane from the third vertex to a fourth vertex
- a fifth leg extending parallel to the ground plane from the fourth vertex to a fifth vertex and
- a sixth leg extending orthogonal to the ground plane from the fifth vertex to an end point.

11. The antenna of claim 10 wherein the fifth vertex lies approximately over the center of the ground plane.

12. The antenna of claim 1 wherein the radiating element is sized and dimensioned to fit within the interior volume of the nosecone.

13. The antenna of claim 12 wherein the radiating element is sized and dimensioned to fit within the interior volume of a Stanag 2916 conforming nosecone.

14. An inverted F antenna for use in the nosecone of a projectile, the inverted F antenna comprising:
- a ground plane configured for being mounted within the opening of the nosecone; and
- a radiating element extending orthogonally from the ground plane, the radiating element further comprising a ground stub trace, a feed trace and a meandering trace, wherein the radiating element is sized and dimensioned for communicating in the S band of the electromagnetic spectrum and for fitting within an interior volume of the nosecone.

15. The antenna of claim 14 wherein the radiating element is sized and dimensioned to fit within the interior volume of a Stanag 2916 conforming nosecone.

16. A spin stabilized projectile comprising:
- a NATO Stanag 2916 conforming nosecone; and
- an inverted F antenna sized and dimensioned to fit within the interior volume of the NATO Stanag 2916 conforming nosecone and communicate on the S band of the electromagnetic spectrum, wherein the inverted F antenna further comprises
  - a ground plane configured for being mounted within the opening of the nosecone; and
  - a radiating element extending orthogonally from the ground plane and centered on the ground plane, the radiating element further comprising a ground stub trace, a feed trace and a meandering trace.

17. The spin stabilized projectile of claim 16 wherein a remaining portion of the interior volume is filled with a filler material.

18. The spin stabilized projectile of claim 16 wherein the filler material is a dielectric foam.

19. The spin stabilized projectile of claim 16 wherein the feed trace lies approximately at the center of the ground plane.

20. The spin stabilized projectile of claim 16 wherein an uppermost leg of the meandering trace lies approximately above the center of the ground plane.

* * * * *